US010134513B2

(12) United States Patent
Hong et al.

(10) Patent No.: US 10,134,513 B2
(45) Date of Patent: Nov. 20, 2018

(54) HIGH SILICON STEEL SHEET HAVING EXCELLENT PRODUCTIVITY AND MAGNETIC PROPERTIES AND METHOD FOR MANUFACTURING SAME

(71) Applicant: POSCO, Gyeongsangbuk-do (KR)

(72) Inventors: Byung-Deug Hong, Kyungsangbook-do (KR); Jin-Mo Koo, Kyungsangbook-do (KR); Jae-Kon Lee, Kyungsangbook-do (KR); Sung-Jin Park, Kyungsangbook-do (KR); Sang-Hoon Kim, Kyungsangbook-do (KR)

(73) Assignee: POSCO, Gyeongsangbuk-Do (KR)

( * ) Notice: Subject to any disclaimer, the term of this patent is extended or adjusted under 35 U.S.C. 154(b) by 710 days.

(21) Appl. No.: 14/366,741

(22) PCT Filed: Dec. 20, 2012

(86) PCT No.: PCT/KR2012/011170
§ 371 (c)(1),
(2) Date: Jun. 19, 2014

(87) PCT Pub. No.: WO2013/095006
PCT Pub. Date: Jun. 27, 2013

(65) Prior Publication Data

US 2014/0366989 A1 Dec. 18, 2014

(30) Foreign Application Priority Data

Dec. 20, 2011 (KR) ..... 10-2011-0138478

(51) Int. Cl.

| | |
|---|---|
| ***C21D 8/12*** | (2006.01) |
| ***H01F 1/147*** | (2006.01) |
| ***C22C 38/02*** | (2006.01) |
| ***C22C 38/06*** | (2006.01) |
| ***C22C 38/00*** | (2006.01) |
| ***H01F 1/16*** | (2006.01) |

(52) U.S. Cl.
CPC ..... *H01F 1/14775* (2013.01); *C21D 8/1227* (2013.01); *C21D 8/1261* (2013.01); *C21D 8/1272* (2013.01); *C22C 38/001* (2013.01); *C22C 38/004* (2013.01); *C22C 38/02* (2013.01); *C22C 38/06* (2013.01); *H01F 1/16* (2013.01); *C21D 8/1211* (2013.01); *C21D 8/1222* (2013.01); *C21D 8/1233* (2013.01)

(58) Field of Classification Search
CPC ..... H01F 1/4775; C21D 8/1222
See application file for complete search history.

(56) References Cited

U.S. PATENT DOCUMENTS 5,164,024 A 11/1992 Nishimoto et al.
5,286,315 A * 2/1994 Iwayama ..... B22D 11/06 148/111
5,676,771 A * 10/1997 Yano ..... C21D 8/1205 148/112
7,140,417 B2 * 11/2006 Schoen ..... C21D 8/1211 164/417
2009/0250145 A1 * 10/2009 Kurosaki ..... B22D 11/001 148/546

FOREIGN PATENT DOCUMENTS

| | | |
|---|---|---|
| CN | 101049669 | 10/2007 |
| CN | 101935800 A | 1/2011 |
| CN | 102002567 | 4/2011 |
| CN | 102199721 | 9/2011 |
| CN | 102260776 | 11/2011 |
| JP | 38-26263 | 12/1938 |
| JP | 45-21181 | 7/1945 |
| JP | 56-003625 | 1/1981 |
| JP | 60-032705 | 2/1985 |
| JP | 62-227078 | 10/1987 |
| JP | 3-65001 | 10/1991 |
| JP | 03 260017 | 11/1991 |
| JP | 05-171281 | 7/1993 |
| JP | 05-279739 | 10/1993 |
| JP | 07-076730 | 3/1995 |
| JP | 07-188751 | 7/1995 |
| JP | 11-222653 | 8/1999 |
| JP | 11-320036 | 11/1999 |
| JP | 2001-295001 | 10/2001 |
| JP | 2004-300535 | 10/2004 |
| JP | 2006-249491 | 9/2006 |
| JP | 2009-007642 | 1/2009 |
| JP | 2010-024509 | 2/2010 |
| JP | 2001-094233 | 5/2011 |
| KR | 10-1994-0000819 | 2/1994 |
| KR | 10-2002-0051312 | 6/2002 |
| KR | 10-0374292 | 9/2002 |
| KR | 10-0368835 | 3/2003 |
| KR | 10-2006-0074646 | 7/2006 |
| WO | WO 2008-050597 | 5/2008 |

OTHER PUBLICATIONS

Machine translation of JPH03-260017 (Japanese language document published Nov. 20, 1991).*

(Continued)

*Primary Examiner* — Christopher S Kessler
(74) *Attorney, Agent, or Firm* — Cantor Colburn LLP

(57) ABSTRACT

Provided is a method for manufacturing a high silicon steel sheet having excellent producibility and magnetic properties. The method includes: casting a molten metal as a strip having a thickness of 5 mm or less, the molten metal comprising, by weight %, C: 0.05% or less (excluding 0%), N: 0.05% or less (excluding 0%), Si: 4% to 7%, Al: 0.5% to 3%, Si+Al: 4.5% to 8%, and the balance of Fe and inevitable impurities; hot-rolling the cast strip at a temperature of 800° C. or higher; annealing the hot-rolled strip at a temperature within a range of 900° C. to 1200° C.; cooling the annealed strip; warm-rolling the quenched strip at a temperature within a range of 300° C. to 700° C.; and finally annealing the warm-rolled strip at a temperature within a range of 800° C. to 1200° C.

8 Claims, 3 Drawing Sheets

(56) References Cited

OTHER PUBLICATIONS

Machine translation of JP H11-222653 (Japanese language document published on Aug. 17, 1999).*
International Search Report from the Korean Patent Office in International application No. PCT/KR2012/011170, dated Apr. 25, 2013, 4 pages.
Decision of Rejection from the Japanese Patent Office dated Apr. 5, 2016 in counterpart Japanese Patent Application No. 2014-548663.
Chinese Office Action dated Dec. 24, 2014 in corresponding Chinese Application No. 201280062641.9.
Third Office action dated Feb. 29, 2016, from the State Intellectual Property Office of the People's Republic of China in counterpart Chinese Patent Application 2012800626419.
English-language translation of Second Office Action issued by People's Republic of China Patent Office dated Aug. 17, 2015, in counterpart Chinese Patent Application No. 2012800626419.
English-language translation of Notice of Office Action from the Japanese Patent Office in counterpart Japanese Patent Application No. 2014-548663, dated Aug. 25, 2015.

* cited by examiner

【Figure 1】
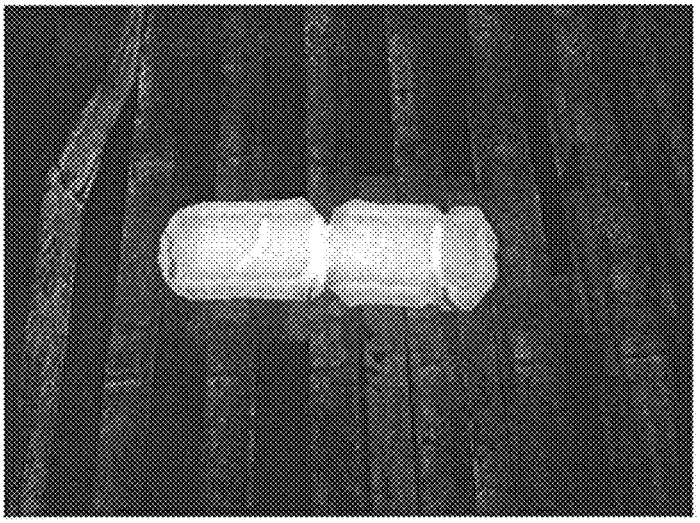

【Figure 2】
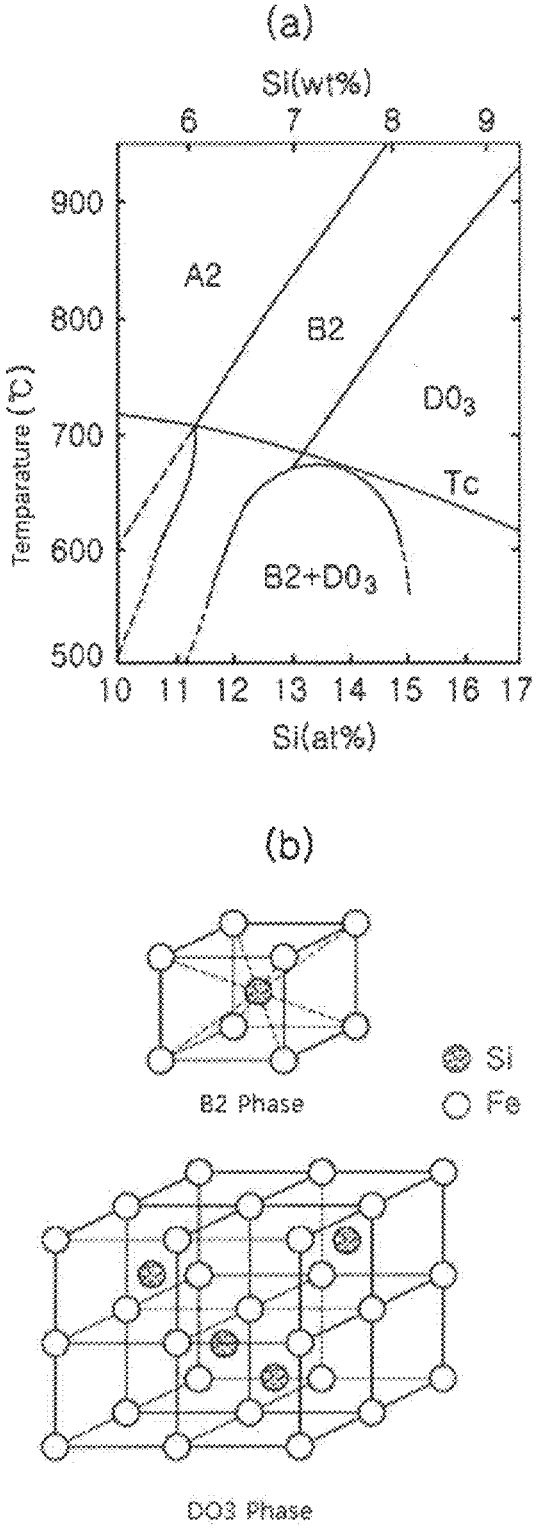

【Figure 3】
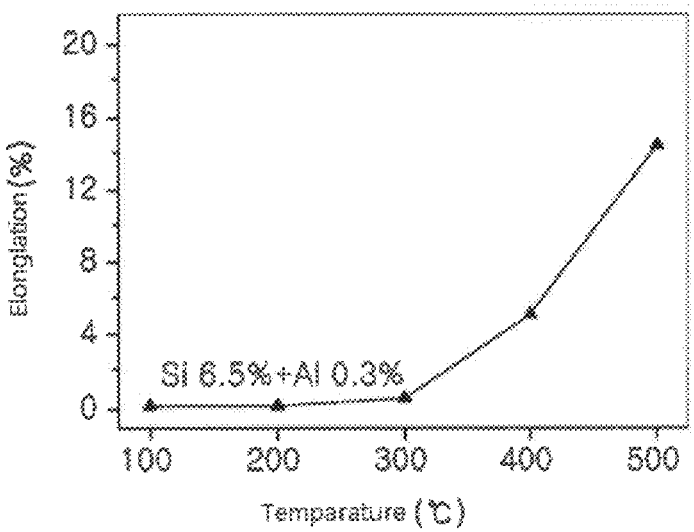
【Figure 4】
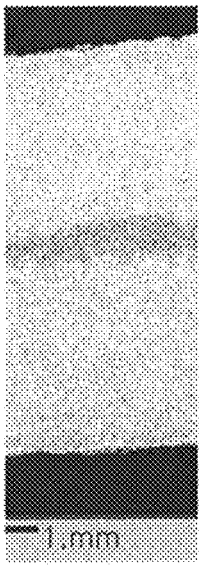

HIGH SILICON STEEL SHEET HAVING EXCELLENT PRODUCTIVITY AND MAGNETIC PROPERTIES AND METHOD FOR MANUFACTURING SAME

TECHNICAL FIELD

The present disclosure relates to a high silicon steel sheet having excellent producibility and magnetic properties, and a method for manufacturing the steel sheet.

BACKGROUND ART

Steel sheets including silicon have good magnetic properties and are thus widely used as electric steel sheets. For example, silicon steel sheets are used as materials for the cores of transformers, electric motors, generators, and other electronic devices, and in this case, silicon steel sheets are required to have good magnetic properties. Particularly, silicon steel sheets are required to be effective in reducing energy loss due to current environmental and energy problems. Concern about environmental and energy problems may be related to magnetic flux density and core loss. That is, as the density of magnetic flux is increased, the size of cores can be reduced to make electric devices smaller, and as core loss is reduced, energy loss is also reduced.

Core loss causing energy loss includes eddy current loss and hysteresis loss. As the frequency of an alternating current (AC) current increases, the amount of eddy current loss increases. Eddy current loss occurs in the form of heating when a magnetic field is applied to a core, and silicon is added to a core to reduce eddy current loss in the core. If the content of silicon in steel is increased to 6.5%, magnetostriction causing noise does not occur (0%), and the permeability of the steel is maximized. In addition, in the case that the content of silicon in steel is 6.5%, the magnetic properties of the steel may be markedly improved. Therefore, high silicon steel having good magnetic properties may be used in high-value electrical devices such as inverters and reactors for new renewable energy power stations, induction heaters for gas turbine power generators, and reactors for uninterruptable power supplies.

High silicon steel sheets including a silicon content of 6.5% are excellent in terms of magnetic properties. However, as the silicon content of steel sheets is increased, the steel sheets are increased in brittleness and markedly decreased in elongation properties. Thus, it is known that silicon steel sheets having a silicon content of 3.5% or greater are practically impossible to manufacture using general cold-rolling methods. That is, high silicon steel sheets known as having good magnetic properties are not manufactured by cold-rolling methods due to inherent limitations of cold-rolling technology. Thus, research into new technology has long been conducted to overcome limitations of cold-rolling methods.

Since it is difficult to manufacture high silicon steel sheets having good magnetic properties through a general hot-rolling process and a general cold-rolling (or warm-rolling) process, there have been attempts to manufacture high silicon steel sheets through other methods.

Methods currently known as techniques for manufacturing high silicon steel sheets are casting methods in which high silicon steel sheets having a final thickness are directly manufactured through a casting process using a single roll or a pair of rolls. An example of such a method is disclosed in Patent Document 1. In such methods, however, it is very difficult to control the shape of a cast plate. Particularly, if molten steel is directly cast as a plate having a final product thickness, the surface of the plate may be very rough and easily cracked, and thus it is difficult to obtain plates having improved magnetic properties using such a direct casting method. In addition, such a direct casting method is not suitable for commercial mass production because of uneven thicknesses of cast plates. Patent Document 2 discloses a so-called clad method in which high silicon steel covered with low silicon steel is rolled. However, the disclosed method has not yet been commercialized.

In addition, Patent Document 3 discloses a powder metallurgy technique for making a high silicon steel block as a substitute for a high silicon steel sheet. Although pure iron powder cores, high silicon steel powder cores, and Sendust powder cores are used in combination, such cores have soft magnetic properties inferior to those of high silicon steel sheets because of characteristics of powders they are produced from.

According to current mass-production technology for manufacturing high silicon steel sheets having a silicon content of 6.5%, a chemical vapor deposition (CVD) method is used to diffuse $SiCl_4$ into a steel sheet having a silicon content of 3% during an (diffusion) annealing process. Many examples of the technology such as that disclosed in Patent Document 4 are known. According to the technology, however, toxic $SiCl_4$ is used, and it takes a significant amount of time to perform a diffusion annealing process.

In addition, there have been attempts to manufacture thin high silicon steel sheets in laboratories by a so-called warm-rolling method in which the temperature of a rolling process is increased. If slabs are manufactured through a general continuous casting process, the slabs are heated to 1100° C. or higher for several hours in a reheating furnace before a hot-rolling process, and at this time the slabs may crack due to differences in temperature between the surfaces and centers thereof. In addition, when the slabs are removed from the reheating furnace and hot-rolled, the slabs may fracture. For example, FIG. 1 illustrates 6.5%-Si steel melted in a 50-kg vacuum induction melting furnace, formed into a 200-mm slab by milling, heated to 1100° C. for one and a half hours under an argon (Ar) atmosphere, and immediately hot-rolled. The slab fractured during hot-rolling. This technique of increasing rolling temperature may improve rolling characteristics of steel but causes many other problems during a hot-rolling process.

(Patent Document 1) Japanese Patent Application Laid-open Publication No. S56-003625

(Patent Document 2) Japanese Patent Application Laid-open Publication No. H5-171281

(Patent Document 3) Korean Patent No. 0374292

(Patent Document 4) Japanese Patent Application Laid-open Publication No. S62-227078

DISCLOSURE

Technical Problem

Aspects of the present disclosure may provide a high silicon steel sheet having excellent producibility and magnetic properties, and a method for manufacturing the steel sheet.

Technical Solution

According to an aspect of the present disclosure, a high silicon steel sheet having excellent producibility and magnetic properties may include, by weight %, C: 0.05% or less (excluding 0%), N: 0.05% or less (excluding 0%), Si: 4% to 7%, Al: 0.5% to 3%, Si+Al: 4.5% to 8%, and the balance of Fe and inevitable impurities.

According to another aspect of the present disclosure, a method for manufacturing a high silicon steel sheet having excellent producibility and magnetic properties may include: casting a molten metal as a strip having a thickness of 5 mm or less, the molten metal including, by weight %, C: 0.05% or less (excluding 0%), N: 0.05% or less (excluding 0%), Si: 4% to 7%, Al: 0.5% to 3%, Si+Al: 4.5% to 8%, and the balance of Fe and inevitable impurities; hot-rolling the cast strip at a temperature of 800° C. or higher; annealing the hot-rolled strip at a temperature within a range of 900° C. to 1200° C.; cooling the annealed strip; warm-rolling the cooled strip at a temperature within a range of 300° C. to 700° C.; and finally annealing the warm-rolled strip at a temperature within a range of 800° C. to 1200° C.

The above-described aspects of the present disclosure do not include all aspects or features of the present disclosure. Other aspects or features, advantages, and effects of the present disclosure will be clearly understood from the following descriptions of embodiments.

Advantageous Effects

According to the present disclosure, a high silicon steel sheet having good magnetic properties may be provided by performing strip casting, hot-rolling, hot-rolled strip annealing, cooling, warm-rolling, and annealing processes in combination on steel having a silicon content of 5 weight % or higher. In addition, a high silicon steel sheet having improved rolling properties and may be provided by controlling the contents of silicon (Si) and aluminum (Al) relative to each other.

DESCRIPTION OF DRAWINGS

FIG. 1 is an image of a hot-rolled plate fractured during a hot-rolling process.

FIGS. 2A and 2B are a Si—Fe phase diagram and a view showing atomic arrangements in a B2 ordered structure and a $DO_3$ ordered structure.

FIG. 3 is a graph showing the elongation of a high silicon steel sheet with respect to temperature.

FIG. 4 is an image showing Si-segregation occurring during a strip casting process.

BEST MODE

The inventors have conducted research into techniques for preventing fractures of steel sheets during hot-rolling processes and improving brittleness of steel sheets for cold-rolling processes. As a result, the inventors have found that high silicon steel sheets free from fractures during hot-rolling processes and improved in terms of brittleness for cold-rolling processes can be mass-produced by properly adjusting the composition of steel, manufacturing a thin steel sheet directly through a strip casting process, and then warm-rolling the thin steel sheet.

Hereinafter, a high silicon steel sheet will be described in detail according to an embodiment of the present disclosure.

An embodiment of the present disclosure provides a high silicon steel sheet having excellent producibility and magnetic properties. The high silicon steel sheet includes, by weight %, C: 0.05% or less (excluding 0%), N: 0.05% or less (excluding 0%), Si: 4% to 7%, Al: 0.5% to 3%, Si+Al: 4.5% to 8%, and the balance of Fe and inevitable impurities.

Carbon (C): 0.05 Weight % or Less (Excluding 0%)

Since carbon (C) finely precipitates in steel and hinders movement of dislocations during a rolling process, if the content of carbon (C) in the steel sheet is high, rolling properties of the steel sheet may be worsen. In addition, if carbon (C) is not removed from a final product, the remaining carbon (C) may hinder movement of magnetic domains in an AC magnetic field and thus may worsen magnetic properties of the final product. If the content of carbon (C) in the steel sheet is greater than 0.05%, the brittleness of the steel sheet may be increased, and thus rolling properties of the steel sheet may deteriorate.

Nitrogen (N): 0.05 Weight % or Less (Excluding 0%)

Nitrogen (N) is an interstitial element and hinders the movement of dislocations during a rolling process like carbon (C). Therefore, if a large amount of nitrogen is added to the steel sheet, rolling properties of the steel sheet may deteriorate. In addition, if a large amount of nitrogen (N) is included in a final product, magnetic domains may be hindered from moving in an AC magnetic field, and thus magnetic properties of the final product may deteriorate. Therefore, it may be preferable that the upper limit of the content of nitrogen (N) be 0.05 weight %.

Silicon (Si): 4 Weight % to 7 Weight %

Silicon (Si) increases the specific resistance of the steel sheet and thus reduces core loss. If the content of silicon (Si) is less than 4 weight %, the magnetic properties of the steel sheet intended in the embodiment of the present disclosure may not be obtained. On the other hand, if the content of silicon (Si) is greater than 7 weight %, it may be difficult to process the steel sheet. Therefore, it may be preferable that the content of silicon (Si) be within the range of 4 weight % to 7 weight %.

Aluminum (Al): 0.5 Weight % to 3 Weight %

Aluminum (Al) is the most effective element next to silicon (Si) in terms of increasing the specific resistance of the steel sheet. If aluminum (Al) is substituted for silicon (Si), the effect of increasing specific resistance may be relatively low as compared with the case of using silicon (Si). However, rolling properties of the steel sheet may be improved. If the content of aluminum (Al) is less then 0.5 weight %, the effect of improving rolling properties may not be obtained, and if the content of aluminum (Al) is greater than 3 weight %, the effect of improving magnetic properties may not be obtained. Therefore, it may be preferable that the content of aluminum (Al) be within the range of 0.5 weight % to 3 weight %.

The contents of silicon (Si) and aluminum (Al) may be controlled by adjusting the content of Si+Al for hot-rolling and cold-rolling processes according to an embodiment of the present disclosure. That is, for example, the specific resistance of the steel sheet may be increased to lower core loss by controlling the contents of silicon (Si) and aluminum (Al) relative to each other. If the content of Si+Al in the steel sheet is less than 4.5 weight %, high-frequency characteristics of the steel sheet may deteriorate, and if the content of Si+Al is greater than 8 weight %, it may be difficult to process the steel sheet. Therefore, it may be preferable that the content of Si+Al be within the range of 4.5 weight % to 8 weight %.

In the embodiment of the present disclosure, the other component of the steel sheet is iron (Fe). However, impurities from raw materials or manufacturing environments may be inevitably included in the steel sheet, and thus, such impurities may not be entirely removed from the steel sheet. Such impurities are well-known to those of ordinary skill in manufacturing industries, and thus, descriptions thereof will not be given in the present disclosure.

Hereinafter, a method for manufacturing a high silicon steel sheet will be described in detail according to an embodiment of the present disclosure.

According to the embodiment of the present disclosure, the method for manufacturing a high silicon steel sheet includes: casting a molten metal as a strip having a thickness of 5 mm or less, the molten metal including, by weight %, C: 0.05% or less (excluding 0%), N: 0.05% or less (excluding 0%), Si: 4% to 7%, Al: 0.5% to 3%, Si+Al: 4.5% to 8%, and the balance of Fe and inevitable impurities; hot-rolling the cast strip at a temperature of 800° C. or higher; annealing the hot-rolled strip at a temperature within a range of 900° C. to 1200° C.; cooling the annealed strip; warm-rolling the cooled strip at a temperature within a range of 300° C. to 700° C.; and finally annealing the warm-rolled strip at a temperature within a range of 800° C. to 1200° C.

Strip Casting

It is very difficult to manufacture high silicon steel sheets using a general hot-rolling method. However, the inventors have found that a hot-rolled strip (steel sheet) can be simply manufactured by casting a molten metal having the above-described composition into a strip (strip casting). Thus, a strip casting method is used in the embodiment of the present disclosure.

If high silicon steel sheets are manufactured using a general hot-rolling method, slabs may crack due to a temperature difference between inner and outer portions thereof during cooling and heating processes. In addition, if the surfaces of the slabs having a high silicon content are heated to 1200° C. or higher, fayalite ($Fe_2SiO_4$) having a low melting point may be formed to cause erosion of the surfaces (including lateral surfaces) of the slabs and to thus cause cracks, and the slabs may be cracked while being hot-rolled because of high brittleness.

However, if a molten metal having the above-described composition is cast into a strip as proposed by the inventors, a high silicon steel sheet having a thickness of 1 mm to 2 mm may be directly manufactured, and the high silicon steel sheet may be free from cracks unlike a high silicon steel sheet manufactured using a general hot-rolling method. In addition, if a strip casting machine is connected to a hot-rolling mill, hot-rolling may be continuously performed to further reduce the thickness of the high silicon steel sheet. In addition, as shown in FIG. 4, silicon (Si) may segregate in a center region of the high silicon steel sheet manufactured by the strip casting process. The segregation of silicon (Si) may improve rolling properties of the high silicon steel sheet.

In the embodiment of the present disclosure, an initial casting thickness of the strip may be determined depending on the thickness of a final product. For example, it may be preferable that the initial casting thickness be set to be 5.0 mm or less. More preferably, the initial casting thickness may be set to be within the range of 1.0 mm to 5.0 mm. If the initial casting thickness is greater than 5.0 mm, the load during a later warm-rolling process may be increased, and thus productivity may deteriorate. On the other hand, if the initial casting thickness is less than 1.0 mm, the strip casting machine may be excessively elongated, and there may be a limit to increasing the surface quality of the strip by warm-rolling.

Furthermore, the strip casting process may be performed under at least one of a nitrogen atmosphere and an argon atmosphere.

Hot Rolling

The cast strip formed as described above may be processed through a hot-rolling process. The hot-rolling process may reduce the load of a later warm-rolling process and break down a cast microstructure of the strip to form fine grains in the strip. It may be preferable that the process temperature of the hot-rolling process be set to be 800° C. or higher. If the process temperature is lower than 800° C., a B2 ordered structure as shown in FIG. 2B may be easily formed in the strip as shown in FIG. 2A, and thus the ductility of the strip may be lowered to cause brittle fractures. In view of ductility improvement and economical aspects, it may be preferable that the upper limit of the process temperature of the hot-rolling process be 900° C.

Annealing of Hot-Rolled Strip

The hot-rolled strip is annealed. The annealing of the hot-rolled strip is performed to remove hot-rolling stress from the strip. It may be preferable that the annealing temperature be set to be within the range of 900° C. to 1200° C. If the annealing temperature is lower than 900° C., recrystallization of the strip may not completed, and thus a desired degree of ductility may not be obtained. On the other hand, if the annealing temperature is greater than 1200° C., coarse grains may be formed by recrystallization, and thus the strength of the strip may be lowered. Therefore, it may be preferable that the annealing temperature be within the range of 900° C. to 1200° C.

The annealing process may be performed on the hot-rolled strip under a non-oxidizing atmosphere. The non-oxidizing atmosphere may be at least one of a nitrogen atmosphere, an argon atmosphere, and a hydrogen and nitrogen mixture atmosphere.

In addition, the annealing process may be continued until recrystallization is completed. Preferably, the annealing process may be performed for 10 seconds to 5 minutes.

Cooling

The strip annealed as described above is cooled. Preferably, the annealed strip may be cooled to a temperature range of 100° C. to room temperature, preferably, to a temperature range of 95° C. to 105° C., within a cooling time period of 5 seconds to 1 minute. In detail, it may be preferable that the rate of cooling range from 13° C./sec to 160° C./sec. If the rate of cooling is lower than 13° C./sec, cracks may be formed in an edge region of the strip, and rolling properties of the strip may not be improved by the cooling process due to the generation of ordered phase. On the other hand, if the rate of cooling is higher than 160° C./sec, rolling properties and economical efficiency intended in the embodiment of the present disclosure may not be obtained together.

Warm-Rolling

The cooled strip may be warm-rolled within the temperature range of 300° C. to 700° C. Referring to FIG. 3, the cooling strip has a critical point at 300° C. because the content of Si+Al in the strip is properly determined. In detail, the ductility of the strip is very low at temperatures lower than 300° C. If the process temperature of the warm-rolling process is greater than 700° C., problems may occur in a later process such as a pickling process. Therefore, it may be preferable that the process temperature of the warm-rolling process be within the range of 300° C. to 700° C.

In addition, after the warm-rolling process, the strip may have a final thickness of 0.5 mm or less.

Final Annealing

The warm-rolled strip (steel sheet) is annealed. It may be preferable that the annealing temperature be set to be within the range of 800° C. to 1200° C. If the annealing temperature is lower than 800° C., grains may be insufficiently grown, and a desired degree of core loss may not be obtained. On the other hand, if the annealing temperature is greater than 1200° C., economic efficiency and productivity may be lowered, and the formation of a surface oxide layer may be facilitated even in the case that a non-oxidizing atmosphere is used. Such a surface oxide layer may hinder the movement of magnetic domains, and thus magnetic properties of the strip may deteriorate. Therefore, it may be preferable that the annealing temperature be within the range of 800° C. to 1200° C.

In addition, the annealing process may be continued until recrystallization is completed. Preferably, the annealing process may be performed for 10 seconds to 5 minutes.

MODE FOR INVENTION

High silicon steel alloys each including, by weight %, a carbon content of 0.005%, a nitrogen content of 0.0033%, and silicon and aluminum contents as shown in Table 1 were cast as strips having a thickness of 2.0 mm by using a vertical double roll strip caster. Thereafter, the cast strips having a thickness of 2.0 mm were hot-rolled to form high silicon steel sheets having a thickness of 1.0 mm by using a hot-rolling mill connected to the strip caster. The starting temperature of the hot-rolling process was 1050° C. The hot-rolled high silicon steel sheets were heated under an atmosphere including 20% of hydrogen and 80% of nitrogen at a temperature of 1000° C. for 5 minutes, and were then quenched to room temperature at a cooling rate of 200° C./sec. Thereafter, the high silicon steel sheets were pickled with a hydrochloric acid solution to remove surface oxide layers. The thickness of the heat-treated high silicon steel sheets was reduced to 0.1 mm at a temperature of 400° C. Then, an annealing process was performed on the high silicon steel sheets at 1000° C. for 10 minutes under a dry atmosphere including 20% of hydrogen and 80% of nitrogen and having a dew point of −10° C. or lower, so as to obtain final magnetic properties. Thereafter, rolling and magnetic properties of the high silicon steel sheets were measured.

In Table 1, B50 refers to magnetic flux density values, and high silicon steel sheets having high magnetic flux density values are evaluated as having good magnetic properties. In addition, W10/400 and W10/1000 refer to core loss values measured at commercial frequency, and high silicon steel sheets having low core loss values are evaluated as having poor magnetic properties.

TABLE 1

| | | | | Magnetic properties | | |
|---|---|---|---|---|---|---|
| No. | Si (wt %) | Al (wt %) | Rolling properties | B50 | W10/400 (W/kg) | W10/1000 (W/kg) |
| *CS 1 | 7.0 | Not added | Bad | 1.53 | 6.55 | 24.0 |
| CS 2 | 6.5 | 0.3 | Normal | 1.61 | 6.04 | 23.2 |
| **IS 1 | 6.1 | 0.7 | Good | 1.63 | 5.07 | 18.2 |
| IS 2 | 5.6 | 1.5 | Excellent | 1.64 | 5.15 | 18.5 |
| IS 3 | 4.8 | 2.0 | Excellent | 1.66 | 5.35 | 19.1 |
| CS 3 | 3.8 | 3.0 | Excellent | 1.67 | 6.02 | 28.2 |

*CS: Comparative Samples,
**IS: Inventive Samples

As shown in Table 1, Inventive Samples 1 to 3 have excellent rolling properties because the contents of Si and Al thereof are controlled according to the embodiments of the present disclosure. In addition, the magnetic flux density values B50 of Inventive Samples 1 to 3 are higher than those of Comparative Samples 1 to 3, and the core loss values W10/400 and W10/1000 of the Inventive Samples 1 to 3 are lower than those of Comparative Samples 1 to 3. That is, the magnetic properties of the Inventive Samples 1 to 3 are good.

Comparative Sample 1 has bad rolling properties because aluminum (Al) is not added thereto, and magnetic properties of Comparative Sample 1 are not good.

Comparative Sample 2 has normal rolling properties because the content of aluminum (Al) is low. In addition, Comparative Sample 2 has a magnetic flux value B50 lower than those of Inventive Samples 1 to 3 and core loss values W10/400 and W10/1000 higher than those of Inventive Samples 1 to 3. That is, the magnetic properties of Comparative Sample 2 are not good.

Comparative Sample 3 has excellent rolling properties because of a high aluminum content of 3 weight %. However, Comparative Sample 3 has core loss values W10/400 and W10/1000 higher than those of Inventive Samples 1 to 3. That is, the magnetic properties of Comparative Sample 3 are not good.

Those results show the effect of control of the contents of silicon (Si) and aluminum (Al).

Embodiment 2

A silicon steel alloy including, by weight %, 6.3% of Si, 0.3% of Al, 0.002% of C, and 0.003% of N was cast into strips having a thickness of 2.0 mm by using a vertical double roll strip caster. Thereafter, the cast strips having a thickness of 2.0 mm were hot-rolled to form high silicon steel sheets having a thickness of 1.0 mm by using a hot-rolling mill connected to the strip caster. The start temperature of the hot-rolling process was 1000° C. An annealing process was performed by heating the hot-rolled high silicon steel sheets under an atmosphere including 20% of hydrogen and 80% of nitrogen at a temperature of 1000° C. for 5 minutes, and then the high silicon steel sheets were cooled at different cooling rates. In detail, the high silicon steel sheets were cooled from 800° C. to 100° C. at cooling rates of 100° C./sec and 10° C./sec, respectively. The heat-treated high silicon steel sheets (samples) were pickled with a hydrochloric acid solution to remove surface oxide layers, and then warm-rolled at 400° C. Thereafter, the samples were inspected for cracks. The thickness of samples cooled at a cooling rate of 100° C./sec within the cooling range proposed in the embodiments of the present disclosure could be reduced up to 0.1 mm, and cracks were not observed. However, samples cooled at a cooling rate of 10° C./sec outside of the cooling range proposed in the embodiments of the present disclosure started to crack at edge regions when the reduction ratio thereof exceeded 50%. That is, if the rate of cooling is low, although a steel sheet is heat-treated after being rolled, ordered phases may not be removed from the steel sheet, and thus the rolling properties of the steel sheet may not be improved.

The invention claimed is:

1. A method for manufacturing a high silicon steel sheet, the method comprising:

casting a molten metal by a strip casting machine as a strip having a thickness of 1 mm to 5 mm, the molten metal comprising, by weight %, C: 0.05% or less (excluding 0%), N: 0.05% or less (excluding 0%), Si: 4% to 6.3%, Al: 0.3% to 3%, Si+Al: 4.5% to 8%, and the balance of Fe and inevitable impurities;

hot-rolling the cast strip by a hot rolling mill at a temperature of 800° C. or higher;

annealing the hot-rolled strip at a temperature within a range of 900° C. to 1200° C.;

cooling the annealed strip at a rate of 100° C./sec to 200° C./sec to a temperature range of room temperature to 100° C.;

warm-rolling the cooled strip at a temperature within a range of 300° C. to 700° C.; and annealing the warm-rolled strip at a temperature within a range of 800° C. to 1200° C.

2. The method of claim 1, wherein the casting of the molten metal is performed under at least one of a nitrogen atmosphere and an argon atmosphere.

3. The method of claim 1, wherein the annealing of the hot-rolled strip is performed under a non-oxidizing atmosphere.

4. The method of claim 3, wherein the non-oxidizing atmosphere is at least one of a nitrogen atmosphere, an argon atmosphere, and a hydrogen and nitrogen mixture atmosphere.

5. The method of claim 1, where the warm-rolling of the cooled strip is performed until the cooled strip has a final thickness of 0.5 mm or less.

6. The method of claim 1, wherein the thickness of the strip is 1 mm to 2 mm.

7. The method of claim 1, wherein the annealing of the hot-rolled strip is performed for 10 seconds to 5 minutes.

8. The method of claim 1, wherein the annealing of the warm-rolled strip is performed for 10 seconds to 5 minutes.

* * * * *